United States Patent [19]

Nunemaker

[11] Patent Number: 4,664,093

[45] Date of Patent: May 12, 1987

[54] ARROW REST ASSEMBLY FOR AN ARCHERY BOW

[76] Inventor: John Nunemaker, 3624 Columbus Ave., Anderson, Ind. 46014

[21] Appl. No.: 692,200

[22] Filed: Jan. 17, 1985

[51] Int. Cl.[4] ..... F41B 5/00; F41D 10/00

[52] U.S. Cl. ..... 124/24 R; 124/41 A

[58] Field of Search ..... 124/24 R, 41 A, DIG. 1

[56] References Cited

U.S. PATENT DOCUMENTS

| | | | |
|---|---|---|---|
| 3,871,352 | 3/1975 | Stanislawski et al. | 124/41 A |
| 3,935,854 | 2/1976 | Troncosco | 124/24 R |
| 4,278,066 | 7/1981 | Zinz | 124/41 A |
| 4,299,195 | 11/1981 | Norris | 124/24 R |
| 4,344,409 | 8/1982 | Barner | 124/24 R |
| 4,378,780 | 4/1983 | Izuta | 124/24 R |
| 4,398,354 | 8/1983 | Finlay | 124/24 R |

*Primary Examiner*—Richard C. Pinkham
*Assistant Examiner*—Benjamin Layno
*Attorney, Agent, or Firm*—Woodard, Weikart, Emhardt & Naughton

[57] ABSTRACT

An arrow rest assembly for an archery bow comprises a thin strip member having a V-shaped notch at one end for supporting an arrow shaft. The strip member is mounted to the mid-portion of the bow in a stabilized fixed position relative to the bow. The mounting of the strip member to the bow includes an arm pivotally connected to and extending rearwardly from the mid-portion of the bow, an elongate rod extending horizontally and laterally of the mid-portion of the bow and slidably and pivotally mounted to the arm, a stabilizer member fixedly attached to the rod, and a resilient flexible plate member fixedly mounted on the stabilizer member and supporting the strip member. The stabilizer member and plate provide increased stability for maintaining the strip member in a desired fixed position relative to the bow.

5 Claims, 5 Drawing Figures

ARROW REST ASSEMBLY FOR AN ARCHERY BOW

BACKGROUND OF THE INVENTION

The present invention relates generally to archery bows and, more particularly, to an improved arrow rest assembly for an archery bow.

Arrow rests are devices which are used to stabilize arrow position prepatory to arrow release by supporting the forward portion of the arrow. Conventional arrow rests may comprise a lateral extension of the midportion of the bow which defines a horizontal flat surface upon which the arrow rests. A rest of this type is suboptimal in that the fletching of the arrow makes contact with the rest as the arrow travels forward upon its release, causing a deflection which negatively affects accuracy of arrow travel.

An arrow rest of improved construction over that just mentioned above includes an arrow supporter comprising a relatively thin metal strip with a V-shaped end portion upon which the arrow rests. The metal strip is spaced laterally from the bow and connected to the midportion thereof by an adjustable connecting means which is intended to maintain the arrow supporter in an adjustable fixed position. Since the arrow supporter is of a rather thin, fragile construction, it is easily damaged or knocked out of its desired position during use or even during transportation.

The following patent references are believed to be generally relevant to the present invention:

| U.S. Pat. No. | Inventor | Title |
|---|---|---|
| 4,278,066 | Zinz, Sr. | Flipper Rest |
| 4,299,195 | Norris | Arrow Rest Assembly |
| 4,398,354 | Finlay | Bow Square Head |
| 4,378,780 | Izuta | Arrow Rest For Archery Bow |
| 4,344,409 | Barner | Arrow Rest Apparatus |

U.S. Pat. No. 4,278,066 to Zinz, Sr. discloses a flipper rest which is adapted to support an arrow and which swings out of the way as an arrow is launched apparently without deflecting the arrow.

U.S. Pat. No. 4,299,195 to Norris discloses an arrow rest assembly which includes a coilspring having multidirectional flexibility in various planes to dampen arrow oscillations during arrow release.

U.S. Pat. No. 4,398,354 to Finlay discloses an bow square head which serves to accurately locate the nocking point on a bow string. The bow is provided with an arrow rest of conventional construction.

U.S. Pat. No. 4,378,780 to Izuta discloses an arrow rest for an archery bow which is constructed so as to be supported at a position remote from the sight window defining wall of the bow. The arrow rest extends obliquely towards the back of the bow.

U.S. Pat. No. 4,344,409 to Barner discloses a pivoting arrow rest apparatus which apparently moves away from the path of the released arrow without depending upon arrow contact to effect movement.

SUMMARY OF THE INVENTION

An arrow rest assembly for an archery bow, according to one embodiment of the present invention comprises an arrow launcher supporter including a thin strip member having a V-shaped notch at one end for supporting an arrow shaft. There is also provided a connecting means for connecting the strip member to the mid-portion of the bow and maintaining the strip member in a stabilized fixed position relative to the bow. The connecting means includes an elongate rod extending horizontally and laterally of the mid-portion of the bow. The connecting means further includes a stabilizer member having a base portion of substantially greater thickness than the strip member and which extends forwardly of the rod. The stabilizer member defines a mounting hole which is suitably sized for receiving the rod and which permits the position of the stabilizer member relative to the bow to be adjustable laterally and radially by axial and pivotal movement of the stabilizer member along and about the center axis of the rod. The stabilizer member also includes a means for fixing the position of the stabilizer member on the rod.

It is an object of the present invention to provide an improved arrow launcher.

It is a further object of the present invention to provide an improved arrow rest for an archery bow.

Further objects and advantages of the present invention will become more apparent upon reference to the following figures and detailed description.

DESCRIPTION OF THE PREFERRED EMBODIMENT

Figure 1:
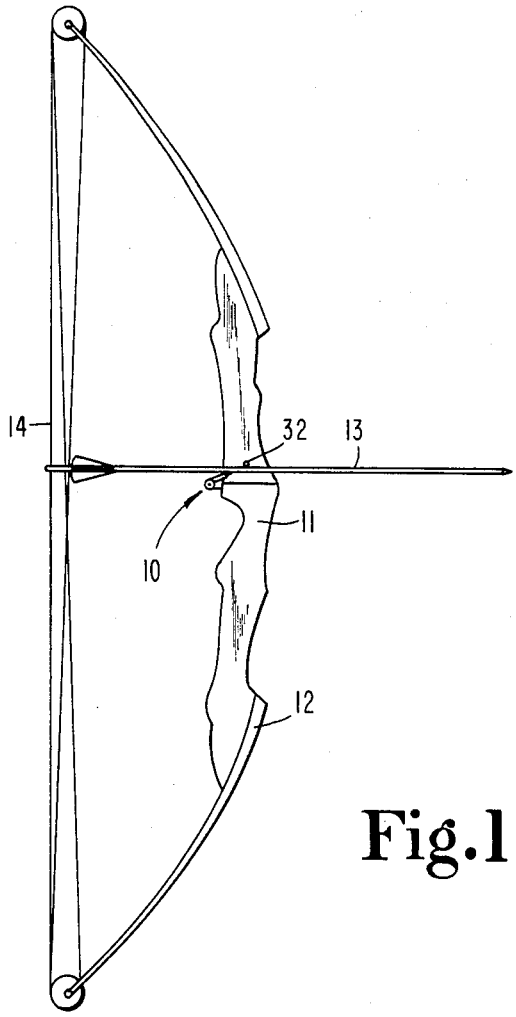
FIG. 1 is an elevation view of the arrow rest of the present invention attached to an archery bow and supporting an arrow.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, FIG. 1 shows the arrow rest of the present invention generally designated at 10 mounted to the mid-portion 11 of an otherwise conventional archery bow 12 and supporting the shaft of an arrow 13 nocked to bowstring 14. While the bow 11 of FIG. 1 is a compound bow, it is to be understood that the arrow rest 10 may be used with bows other than the compound type. The arrow rest 10 mounts to bow 12 in the same manner as the prior art arrow rest 15 shown in FIG. 2. It should be further understood that while the arrow rest 10 is shown in FIG. 1 monted for right hand operation, it may also be oppositely mounted for left hand operation.

Figure 2:
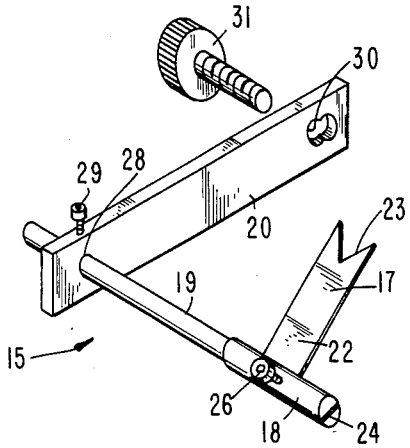
FIG. 2 is a perspective view showing a prior art arrow rest.

Referring principally, to FIG. 2, prior art arrow rest 15 generally includes an arrow launcher supporter 17, a mounting member 18, a connecting rod 19 and adjustable arm 20. The launcher supporter 17 comprises a relatively thin metal strip having a rectangular shaped portion 22 at one end and a V-shaped notch 23 at the other end for supporting an arrow shaft.

It is to be noted that the thickness of launcher supporter 17 is minimized in order to minimize the frictional resistance against an arrow shaft, thus causing less arrow deviation from path during release. The relatively thin, fragile construction of launcher supporter 17 is, however, a disadvantage in that it is important to make the launcher supporter 17 as sturdy as possible to lessen the likelihood of its being damaged or accidentally knocked from its desired position relative to the bow.

The end of launcher supporter 17 opposite notch 20 is received within a slot 24 in mounting member 18 and is fixed thereto by means of a threaded bolt 26. At the end opposite slot 24, mounting member 18 is received over connecting rod 19 in a press fit. Connecting rod 19 extends horizontally behind the the mid-portion 11 of bow 12 and, at the end opposite mounting member 18, is received within mounting hole 28 in arm 20. Rod 19 and mounting hole 28 are cooperably sized to permit rod 19 to be slid laterally or rotated within hole 28 so as to adjust the position of launcher supporter 17 relative to bow 12. Arm 20 is provided with a threaded bolt 29 which may be tightened to secure rod 19 in a fixed position within arm 20. The forward end of arm 20 is provided with an aperture 30 which is shaped to receive therethrough a threaded bolt 31 in eithe rone of two partially overlapping mounting locations. Arm 20 is pivotally adjustable about bolt 31 which is received in a threaded through hole 32 in bow 12 at the side opposite launcher supporter 17. Once adjusted, arm 20 is secured in position by tightening bolt 31.

Figure 5:
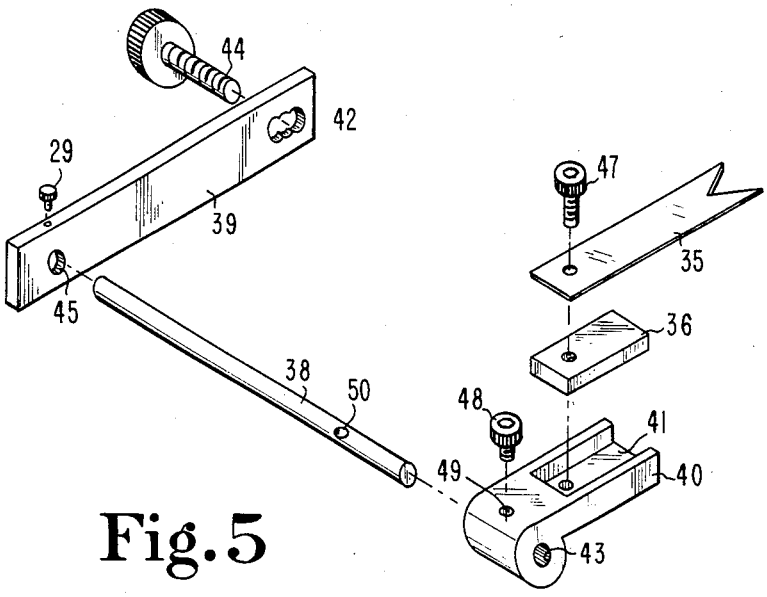
FIG. 5 is an exploded view of the arrow rest of the present invention.
Figure 4:
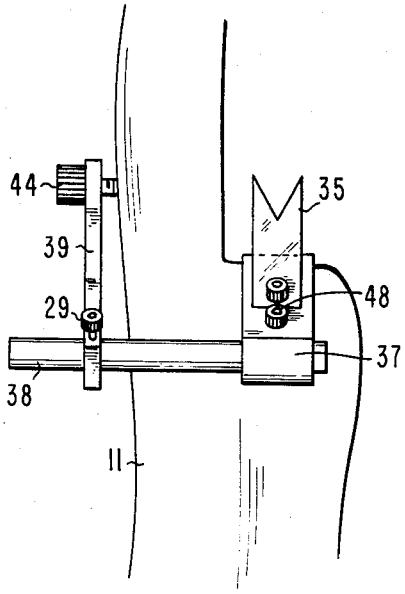
FIG. 4 is a fragmentary rear elevation view showing the arrow rest of the present invention.
Figure 3:
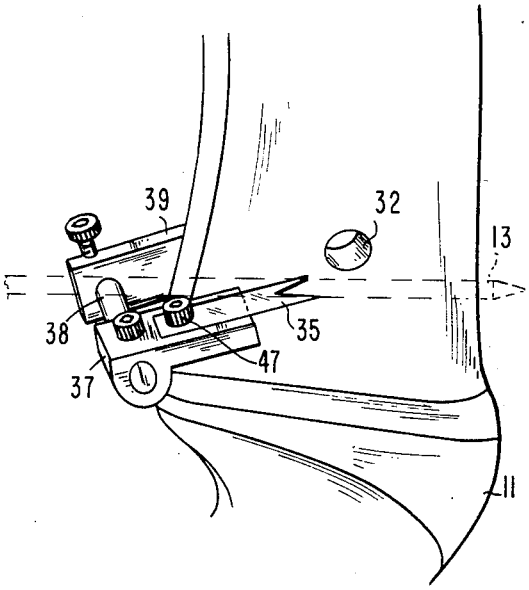
FIG. 3 is a fragmentary side elevation view showing the arrow rest of the present invention.

Referring to FIGS. 3–5, the construction of arrow rest assembly 10 will now be described. Arrow rest assembly 10 generally includes arrow launcher supporter 35, plate 36, stabilizer member 37, connecting rod 38 and adjustable arm 39. Connecting rod 38 and adjustable arm 39 are similar in design and function to connecting rod 19 and adjustable arm 20 previously described, except that the aperture 42 at the forward end of arm 39 is shaped to receive threaded bolt 44 in one of three partially overlapping mounting locations and connecting rod 38 and mounting hole 45 are preferably larger in diameter than the corresponding rod 19 and mounting hole 28 of the prior art arrow rest 15 depicted in FIG. 2. The launcher supporter 35 is similar in construction to launcher supporter 17 except that it is somewhat shorter, owing to the presence of stabilizer member 37.

Stabilizer member 37 has a base portion 40 which is recessed at 41 to receive plate 36 and launcher supporter 35. Base portion 40 is substantially greater in thickness than launcher supporter 35, i.e., preferably on the order of several times its thickness. Both plate 36 and launcher supporter 35 are fixedly mounted to stabilizer member 37 by a threaded bolt 47. At the rearmost portion of stabilizer member 37 a mounting hole 43 is provided which is sized to receive connecting rod 38. The position of stabilizer member 37 relative to arm 39 is adjustable laterally and radially relative to the center axis of rod 38 by laterally sliding and rotating connecting rod 38. A threaded bolt 48 received in aligned threaded holes 49 and 50 serves to secure the position of stabilizer member 37 on rod 38 in place.

Plate 36 is made of a resilient flexible material, its purpose chiefly being to lock the position of launcher supporter 35 on stabilizer member 37 and prevent threaded bolt 47 from loosening, although it may also serve to dampen any vertical movement of launcher supporter 35, thus enhancing its positional stability.

It is to be appreciated that the stabilizer member 37 and flexible plate 36 provides a much sturdier support for the relatively thin, fragile launcher supporter 35 than does the member 18 in arrow rest 15. Further, because launcher supporter 35 extends outwardly of stabilizer member 37 only a short distance, launcher supporter 35 is much less likely to be damaged or knocked from its position relative to bow 12. Yet further, plate 36 provides resilience in the connection between launcher supporter 35 and stabilize member 37, thus adding to stability and dampening any oscillations of launcher supporter 35 caused by contact with an arrow shaft during its release.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An arrow rest assembly for an archery bow, comprising:

an arrow launcher supporter including a thin strip member having a launcher rest at one end for supporting an arrow shaft;

a means for connecting said strip member to the mid-portion of said bow and maintaining said strip member in a stabilized fixed position relative to said bow, said connecting means including an elongate rod extending horizontally and laterally of said mid-portion of said bow, said connecting means further including a stabilizer member integrally including a rear portion and a base portion supporting said strip member, said connecting means further including a fastening means for fastening said strip member to said base portion, said base portion extending forwardly of said fastening means and said rod along the plane of said bow, said base portion having a substantially greater thickness than said strip member, said rear portion of said stabilizer member defining a mounting hole suitably sized for receiving therein said rod, the position of said stabilizer member relative to said bow being adjustable laterally and radially by axial and pivotal movement of said stabilizer member along and about the center axis of said rod, said stabilizer member including means for fixing the position of said stabilizer member on said rod; and a plate member made from a resilient flexible material, said plate member fixedly mounted on said base portion of said stabilizer member, said stabilizer member being relatively rigidly formed as compared to said plate member, said plate member supporting said strip member and providing resilience in the connection between strip member and said stabilizer member.

2. The arrow rest assembly of claim 1 wherein said connecting means further includes an arm connected to said mid-portion of said bow and extending rearwardly therefrom, said arm including means for pivotally adjusting the position of said arm relative to said bow, said arm having a mounting hole at the rearward end sized to receive said rod in a sliding fit, said arm including means for fixing the position of said rod relative to said arm.

3. The arrow rest assembly of claim 1 wherein said base portion of said stabilizer member defines a recess within which is received said plate member and said strip member, said launcher rest of said strip member extending outwardly from and forwardly of said stabilizer member.

4. The arrow rest assembly of claim 3 wherein said connecting means further includes an arm connected to said mid-portion of said bow and extending rearwardly therefrom, said arm including means for pivotally adjusting the position of said arm relative to said bow, said arm having a mounting hole at the rearward end sized to receive said rod in a sliding fit, said arm including means for fixing the position of said rod relative to said arm.

5. An archery bow, comprising:

a bow;

a bowstring spanning the ends of said bow;

an arrow launcher supporter including a thin strip member having a launcher rest at one end for supporting an arrow shaft; and a means for connecting said strip member to the mid-portion of said bow and maintaining said strip member in a stabilized fixed position relative to said bow, said connecting means including an elongate rod extending horizontally and laterally of said mid-portion of said bow, said connecting means further including a stabilizer member integrally including a rear portion and a base portion supporting said strip member, said connecting means further including a fastening means for fastening said strip member to said base portion, said base portion extending forwardly of said fastening means and said rod along the plane of said bow, said base portion having a substantially greater thickness than said strip member, said rear portion of said stabilizer member defining a mounting hole suitably sized for receiving therein said rod, the position of said stabilizer member relative to said bow being adjustable laterally and radially by axial and pivotal movement of said stabilizer member along and about the center axis of said rod, said stabilizer member including means for fixing the position of said stabilizer member on said rod; and a plate member made from a resilient flexible material, said plate member fixedly mounted on said base portion of said stabilizer member, said stabilizer member being relatively rigidly formed as compared to said plate member, said plate member supporting said strip member and providing resilience in the connection between said strip member and said stabilizer member.

* * * * *